US006106223A

United States Patent [19]

Leyshon

[11] Patent Number: 6,106,223

[45] Date of Patent: Aug. 22, 2000

[54] MULTISTAGE VACUUM PUMP WITH INTERSTAGE INLET

[75] Inventor: David Rhodri Leyshon, Tramore, Ireland

[73] Assignee: The BOC Group plc, Windlesham, United Kingdom

[21] Appl. No.: 09/199,178

[22] Filed: Nov. 24, 1998

[30] Foreign Application Priority Data

Nov. 27, 1997 [GB] United Kingdom ..... 9725146

[51] Int. Cl.[7] ..... F04D 19/04

[52] U.S. Cl. ..... 415/90; 415/116; 415/143; 417/250; 417/423.4; 417/423.9

[58] Field of Search ..... 415/90, 143, 121.2, 415/116, 169.1; 417/423.4, 423.9, 424.2, 203, 250

[56] References Cited

U.S. PATENT DOCUMENTS 5,445,502 8/1995 Itou et al. ..... 417/203
5,501,583 3/1996 Nagaoka et al. ..... 417/423.4
5,707,213 1/1998 Conrad ..... 417/423.4

FOREIGN PATENT DOCUMENTS 403233193 10/1991 Japan ..... 417/423.4

*Primary Examiner*—Edward K. Look
*Assistant Examiner*—Liam McDowell
*Attorney, Agent, or Firm*—Philip H. Von Neida; Salvatore P. Pace

[57] ABSTRACT

A vacuum pump comprising a plurality of vacuum stages and having a first pump inlet through which gas can pass through all the pump stages and a second inlet through which gas can enter the pump at an interstage location and pass only through subsequent stages of the pump, wherein the pump stages prior to the interstage are sized differently to these stages subsequent to the interstages such that the pump overall suits the pressure requirements and pumping capacity of the different systems attached to the first and second inlet, respectively.

3 Claims, 1 Drawing Sheet

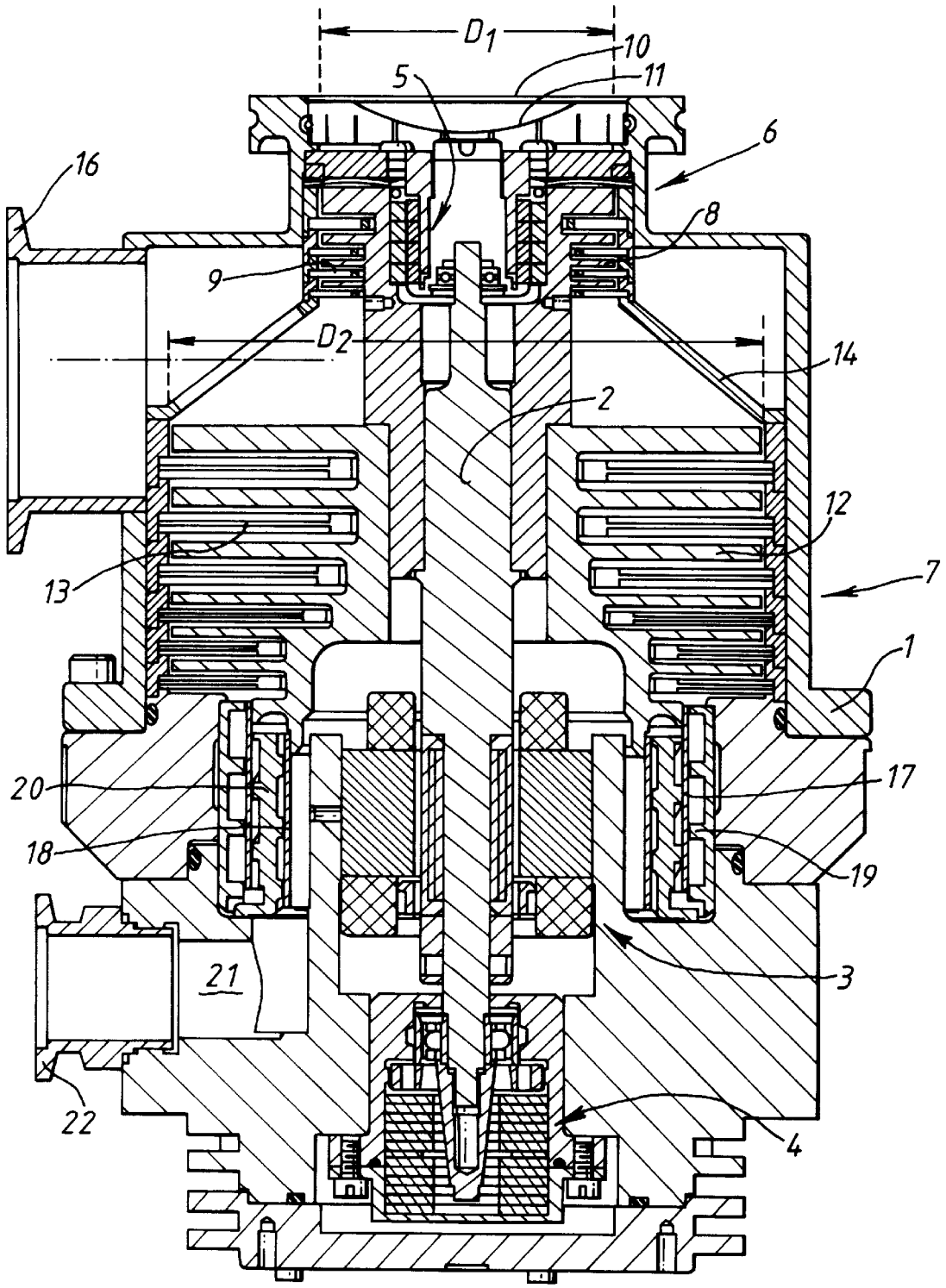
D1
10
11
5
6
16
8
9
D2
14
2
12
13
7
1
20
17
18
19
21
3
22
4

MULTISTAGE VACUUM PUMP WITH INTERSTAGE INLET

TECHNICAL FIELD

This invention relates to improved vacuum pumps with particular reference to those employing a turbo-molecular mode of operation.

BACKGROUND

A conventional turbo-molecular stage arrangement of a vacuum pump comprises a stack of alternate rotors and stators. Each stage effectively comprises a solid disc with a plurality of blades depending (nominally) radially therefrom; the blades are evenly spaced around the circumference of the disc and angled "about" radial lines out of the plane of the disc in the direction of rotation of the rotor stage.

The rotor and stator blades have positive and negative gradients respectively when viewed from the side in a radial line from the disc. This arrangement has the effect in molecular flow conditions of causing the movement of molecules through the pump.

There are a number of types of apparatus where a plurality of chambers needs to be evacuated down to different levels of vacuum. For example, in well known types of mass spectrometer that part of the apparatus known as the detector commonly has to be operated at, say $10^{-6}$ mbar whereas that part known as the analyser has to be operated at a different level of vacuum, say $10^{-3}$mbar.

In addition and importantly, the throughput of gas from the different parts of the apparatus will generally vary also. For example in a typical mass spectrometer of the type discussed above, there may need to be a 60 l/second capacity for the detector and a 200 l/second capacity for the analyser.

In apparatus of the type including but not restricted to mass spectrometers, a number of different vacuum pumps are normally employed. For example, in mass spectrometers, the detector and analyser may be evacuated by separate turbo-molecular vacuum pumps which themselves need to be backed by separate pumps, for example rotary vane pumps.

There is an ever increasing need to rationalise the use of the various vacuum pumps for overall reduced apparatus size and power requirements. A single backing pump is relatively common for supporting two (or more) turbo-molecular pumps. In addition, it has more recently been proposed to employ a single turbo-molecular pump to replace two (or more) individual pumps with the single pump having a normal inlet for gas required to pass through all the stages of the pump and an intermediate inlet, i.e. between the stages, for gas required to pass through only the latter stages of the pump.

However, even these proposals for rationalisation of the apparatus pumping system do not overcome all the problems associated with size and power consumption in particular.

There is therefore a need for improved vacuum pumps in which rationalisation can be further enhanced.

SUMMARY OF THE INVENTION

In accordance with the invention, there is provided a vacuum pump comprising a plurality of vacuum stages and having a first pump inlet through which gas can pass through all the pump stages and a second inlet through which gas can enter the pump at an interstage location and pass only through subsequent stages of the pump, wherein the pump stages prior to the interstage are sized differently to those stages subsequent to the interstage such that the pump overall suits the pressure requirement/pumping capacity of the different systems attended to the first and second inlets respectively.

The invention has advantageous application to turbo-molecular pumps in particular.

In terms of suiting the pressure requirements of the different systems, that system requiring the lower pressure (higher vacuum) will generally need to be attached to the first inlet so that gas being evacuated is subject to all the stages of the pump whereas that system requiring the higher pressure (lower vacuum) will generally need to be attached to the second inlet so that gas being evacuated is subject only to the pump stage subsequent to the interstage.

In those cases, for example, in which the system needing the lower pressure (high vacuum) requires a smaller pumping capacity in terms, in particular, of speed and compression and, for example, in which the system needing the higher pressure requires a higher pumping capacity, the stages prior to the interstage can be of a smaller size than those stages subsequent to the interstage.

In the case of a turbo-molecular pump in particular, this means that the tip diameter of the rotor is smaller in the stages before the interstage than after the interstage.

In the case of turbo-molecular pumps in particular, it is preferred that there are three, four, five, six or more stages (rotor/stator pairs) both before and after the pump interstage.

In preferred embodiments associated with a turbo-molecular pump, one or more Holweck pump stages are employed between the final turbo-molecular stage and the pump outlet.

BRIEF DESCRIPTION OF THE DRAWING

For a better understanding of the invention, reference will now be made to the accompanying drawing which shows a vertical sectional view through a vacuum pump of the invention employing a turbo-molecular mode of operation and also including final Holweck stages.

DETAILED DESCRIPTION OF THE INVENTION

With reference to the drawing, there is shown a vacuum pump having a multi-component body 1 within which is mounted a shaft 2. Rotation of the shaft 2 is effected by means of a motor generally indicated at 3 positioned about the shaft 2. The position of the shaft 2 is controlled by bearings at its base generally indicated at 4 and at its top generally indicated at 5, all of design well known in the art.

The pump possesses two sets of turbo-molecular stages generally indicated at 6 and 7 before and after an interstage therebetween, respectively.

The first set of turbo-molecular stages comprises four rotors (impellers) of angled blade construction as described above and of known construction, one of which is indicated at 8 and four corresponding stators again of angled blade construction and again as described above and of known construction, one of which is indicated at 9 in the drawing.

The tip diameter $D_1$ of the rotors is indicated in the drawing.

An inlet 10 to the first set of stages allows gas entry through a perforated inlet screen 11 in to the four rotor/stator stages of the first set.

A second set of turbo-molecular stages 7 comprises a further six rotors (impellers) of angled blade construction, one of which is indicated at 12 and six corresponding stators again of angled blade construction, one of which is indicated at 13 in the drawing.

The tip diameter $D_2$ of these rotors is also indicated in the drawing.

At an interstage position between the first and second sets of turbo-molecular stages is positioned a stator bridge 14 of heavily perforated design.

Gas exiting from the first set 6 of turbo-molecular stages can pass through the interstage area and into the second set 7 of turbo-molecular stages.

A second inlet 16 is formed in the pump body 1 and allows entry of gas directly in to the interstage area via the apertures in the stator bridge 14.

At the exit of the second set 7 of turbo-molecular stages is a number of Holweck stages. These Holweck stages comprise two rotating cylinders 17, 18 and corresponding annular stators 19, 20 having helical channels formed therein (on one side for stator 19, on both sides for stator 20) all in a general manner known per se.

Gas exiting the Holweck stage is urged into a passageway 21 found in the pump body 1 and thence to a pump outlet 22.

In this embodiment, the sets of turbo-molecular pump stages are therefore sized to reflect the pressure requirements and pumping capacities of the respective vacuum systems to be attached to the inlet 1 and to the inlet 2 thereby leading to overall pump improvements in terms of lower power consumption and smaller size.

What is claimed is:

1. A turbo-molecular vacuum pump comprising a plurality of vacuum stages and having a first pump inlet through which gas can pass through all the pump stages and a second inlet through which gas can enter the pump at an interstage location and pass only through subsequent stages of the pump, wherein the tip diameter of the rotor is smaller in diameter in the stages before said interstate location than after said interstate location, and the pump stages prior to the interstage are sized differently from the stages subsequent to the interstate and a system requiring a lower pressure is attached to said first inlet and a system requiring a higher pressure is attached to said second inlet.

2. A vacuum pump according to claim 1 having at least three turbo-molecular stages both before and after the interstage.

3. A vacuum pump according to claim 1 in which a Holweck stage is employed between the final turbo-molecular stage and the pump outlet.

* * * * *